US005248201A

United States Patent [19]

Kettner et al.

[11] Patent Number: 5,248,201

[45] Date of Patent: Sep. 28, 1993

[54] INTERLOCKING CLOSURE FOR PLASTIC STORAGE BAGS WITH CONFIRMING COLOR STRIPS

[75] Inventors: Catherine E. Kettner, Appleton, Wis.; Jack R. McLean, Richmond, Va.; Mladomir Tomic; Wayne M. Wegner, both of Appleton, Wis.

[73] Assignee: Reynolds Consumer Products Inc., Appleton, Wis.

[21] Appl. No.: 840,250

[22] Filed: Feb. 24, 1992

[51] Int. Cl.[5] ..... B65D 33/24

[52] U.S. Cl. ..... 383/63; 24/587

[58] Field of Search ..... 383/63-65; 24/587

[56] References Cited

U.S. PATENT DOCUMENTS

| | | | |
|---|---|---|---|
| 3,054,434 | 9/1962 | Ausnit et al. | 383/65 |
| 3,198,228 | 8/1965 | Naito | 150/3 |
| 3,226,787 | 1/1966 | Ausnit | 24/201 |
| 3,338,285 | 8/1967 | Jaster | 383/65 |
| 3,389,733 | 6/1968 | Siegel | 24/587 |
| 3,533,548 | 10/1970 | Taterka | 229/48 |
| 3,765,597 | 10/1973 | Brieske | 383/106 |
| 4,186,786 | 2/1980 | Kirkpatrick | 383/63 |
| 4,285,105 | 8/1981 | Kirkpatrick | 24/201 C |
| 4,363,345 | 12/1982 | Scheibner | 24/587 |
| 4,372,014 | 2/1983 | Simpson | 24/201 C |
| 4,578,813 | 3/1986 | Ausnit | 383/65 |
| 4,829,641 | 5/1989 | Williams | 24/587 |
| 4,964,739 | 10/1990 | Branson et al. | 383/5 |
| 5,012,561 | 5/1991 | Porchia et al. | 24/576 |

*Primary Examiner*—Stephen P. Garbe
*Attorney, Agent, or Firm*—Alan T. McDonald

[57] ABSTRACT

An interlocking closure device including two closure elements which interlock over a predetermined length is formed along an open end of a bag to selectively open and close it. A male member projecting from a translucent web on one of the two closure elements and a female member projecting from a translucent web on the other of the closure elements are respectively differently colored. Upon complete mating engagement, the respective colors are respectively observable through the translucent webs as continuous bands of their color. If the closure elements are incompletely mated, then both colors are observable through one or both translucent webs as adjacent band portions of their individual color.

10 Claims, 2 Drawing Sheets

INTERLOCKING CLOSURE FOR PLASTIC STORAGE BAGS WITH CONFIRMING COLOR STRIPS

TECHNICAL FIELD

The present invention relates generally to storage containers having interlocking closure strips and, more particularly, to colored interlocking closure strips wherein the colors are used to confirm whether the two strips are fully interlocked together.

BACKGROUND ART

Various types of plastic bag containers utilize a pair of closure strips respectively having male and female members which interlock together to close the open end of the container and seal the interior from the external environment. The strips and associated container are typically formed from thermoplastic material. The strips are usually formed by extrusion and then connected to the side walls of the container circumscribing the open end by heat sealing or other suitable fastening means. The closure strips and container body may also possibly be formed as a single piece by extrusion.

The interlocking closure strips on the bag bodies are particularly useful for improving the longevity of contents in the container when the closure is fully closed by sealing such contents from the external ambient environment. The closure fastening strips and the bag bodies themselves are generally transparent and the strips therefor have the same general appearance as the bag body. In other words, it is often difficult to actually determine whether the male and female closure strips are fully mated together, so as to completely seal the bag interior.

The above misalignment problem occurs from the user's inability to visually identify when the interlocking closure strips are fully mated to form a seal. As a means for enabling such visual verification, it is known to use a color change means wherein male and female interlocking members having different colors are employed and, upon successful interlocking, blend to provide yet a different color. For example, in U.S. Pat. No. 4,829,641 to Williams, assigned to First Brands Corporation, Danbury, Conn., there is disclosed an interlocking closure device wherein two closure elements are oriented to be interlocked over a predetermined length to seal a bag. Each of the closure elements has different colors for establishing visually the completeness of the mating of the closure elements by providing a color different from the closure elements when the closure elements are successfully and fully fastened. Therein, a color change enhancement member is introduced in an internal channel of a translucent closure element so that the closing and opening of the closure device is more easily detected by visual inspection.

Numerous problems exist in the aforementioned patent and other prior art devices wherein different colors are employed and upon successful interlocking provide yet a different color. For example, in the aforementioned patented prior art, the male and female interlocking members are completely colored instead of being formed from transparent material such as clear resin. The requirement that a colored resin be employed for the entirety of these male and female closure members instead of a clear resin unnecessarily increases costs, i.e., clear resin is less expensive than colored resin.

Another problem associated with the aforementioned prior art is that care must be exercised to insure that two different colors are being used which can be successfully blended together while providing the ability to visually confirm full closure. For example, separate colors to be blended into a third color must be selected so that sufficient contrast is provided between the blended color and the separate colors.

It is accordingly one object of the present invention to enable a user to easily verify whether two closure elements are completely interlocked together.

Another object is to facilitate visual inspection and confirmation of complete interlocking without utilizing additional ribs or guide members on colored interlocking closure devices or by utilizing color change members.

Still another object is to enable visual inspection of a completely interlocked closure device to occur by utilizing the presence of colors but without requiring color change by color blending.

Another object is to utilize color to visually confirm complete interlocking with a minimum of or without color resin to thereby reduce manufacturing costs.

SUMMARY OF THE INVENTION

A container comprises a pair of side walls defining a container interior and at least one open end. A closure device including a first closure element and a second closure element, at least one of which is formed with a web through which color is observable, extend along the open end and are mateable with each other in interlocking engagement member so that, upon successful engagement of the elements along substantially their entire respective lengths, the open end is closed. The first and second elements or members, disposed between the color observable web, are visually observable through the webs. In accordance with the invention, at least one of the first and second elements is colored a certain color so that upon substantially entirely complete mating of the closure elements, the certain color is visually observable through the color observable web as a continuous band of said certain color without any color change.

In accordance with one embodiment of the invention, a portion of the first closure element adapted to directly face and visually observable through the color observable web carrying the second element is colored the certain color and a portion of the second element adapted to directly face and visually observable through a color observable web carrying the first element is colored a second color different from the certain color so that, upon complete mating, the said certain color and said second color are observable through the respective opposing webs as continuous bands of their respective colors and, upon incomplete mating, both said certain color and said second color are visually observable through the opposing web as adjacent bands of said colors along the region of incomplete mating and as an indication thereof.

In accordance with a different embodiment of the invention, the first and second elements are each said certain color.

In one aspect of the invention, at least one of the first and second elements includes a stem or rib projecting upward from the web. This rib extends the full length of the closure element and supports a distal end or tip. The portion which is the certain color may be the tip and rib.

An upward facing surface of the tip which is the surface facing away from its associated web may be said certain color and an opposing surface of said tip which is the surface facing toward the associated web may be the second color. The opposing surface and thereby the second color are visually observable through its associated web when the first and second elements members have incompletely mated and the second color is hidden from view through the associated web when the first and second elements have completely mated.

The colors formed on the upward facing surface and opposing surface of the tip may be co-extruded, with the remainder of the member being a substantially transparent or clear resin co-extruded with the colors. The colors may also be printed on clear resin.

In accordance with a further aspect of the invention, a pair of second elements are spaced from each other along one web and a pair of first elements of like construction as the female members are spaced from each other on the opposite web a distance slightly greater than the spacing between the second elements. A wall projecting upwardly from the associated web extends between the first elements to define locking cavities or channels therewith adapted to respectively receive the second elements therein whose tips interlock by interfitting with and beneath the corresponding tips of the first elements. In one embodiment of this construction, the tips of the first and second elements are each said certain color. In a further aspect of this construction, the tips of at least one of the first and second elements are each said certain color and the tips of the others of the first and second elements are the second color. In accordance with yet an alternative aspect of this construction, the upward facing surfaces of the tips and an opposing surface of the tips are respectively said certain and second colors so that, in the event of incomplete mating, the first and second colors are visually observable through one of the color observable webs.

A method of determining whether a flexible bag container is closed is also disclosed. The container has at least one open end carrying a closure device which includes a first closure element and a female closure elements which are mateable with other so that upon mating engagement along their substantially entire lengths, the open end is substantially entirely closed. The method comprises the steps of inserting the male closure element into the second closure element and then visually observing the mated elements through a color observable web supporting an associated one of the first or second elements to determine whether the certain color appears through the web as a continuous band of said certain color, signifying that full mating has occurred. The said certain color is formed in at least one of the first or second closure elements.

In a further aspect of this invention, the first elements are said certain color and the second elements are a second color. Thereby, each color is separately visually observable through an opposing web as a continuous band of said certain or second color to signify full mating. In the event of incomplete mating, both the certain color and the second color are visually observable through one of the webs.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
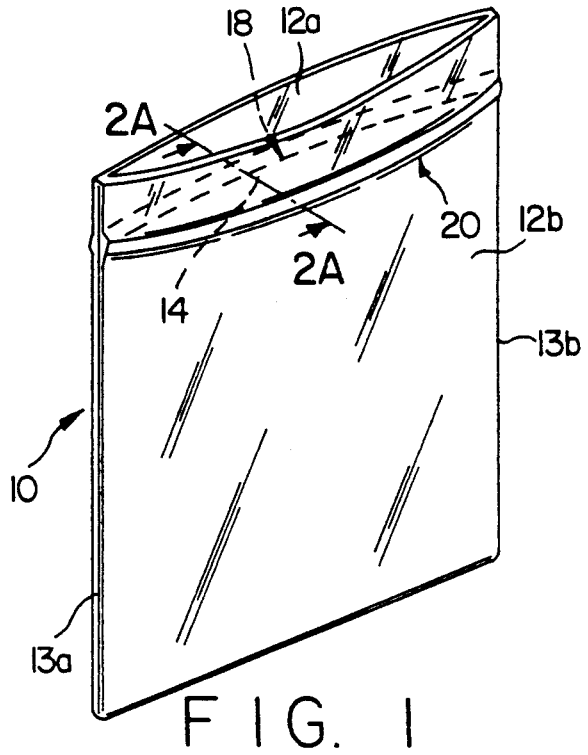
FIG. 1 is an illustration of a transparent flexible bag formed with a pair of interlockable first and second closure elements to which the present invention is applied.

FIG. 1 is an illustration of a container such as a clear flexible bag 10 formed with a pair of plastic side walls 12*a* and 12*b* which may be heat sealed together along their edges 13*a*,13*b* to define a container interior 14 having an open end 16. The open end 16 is defined by upper edge portions 17 of the side walls 12*a*,12*b* extending between the heat sealed edges 13*a*,13*b*. An interlocking closure device in accordance with the present invention includes first and second closure elements 18 and 20 respectively extending along the upper portion 17 of each side wall 12*a*,12*b* in inwardly spaced relation to the open end 16. One of the closure elements 20 is formed with a pair of second members 24 and the other of the closure elements 18 is formed with pair of first members 26 as described hereinafter. In a preferred embodiment (depicted in FIGS. 2A and 2B only), portions 27 of the second members 24 are colored a first or certain color and portions 29 of the first members 26 are colored a second color. When the two closure elements 18,20 properly mate together (FIG. 2A), the first colors 27 only are visually observable through the color observable (e.g., translucent) webs 28,30 carrying the second and first members 24,26. When improperly mated (FIG. 3B), both the first and second colors 27,29 are visually observable through each translucent web 28,30 as adjacent bands of colors along the length of improper mating.

Figure 2A:
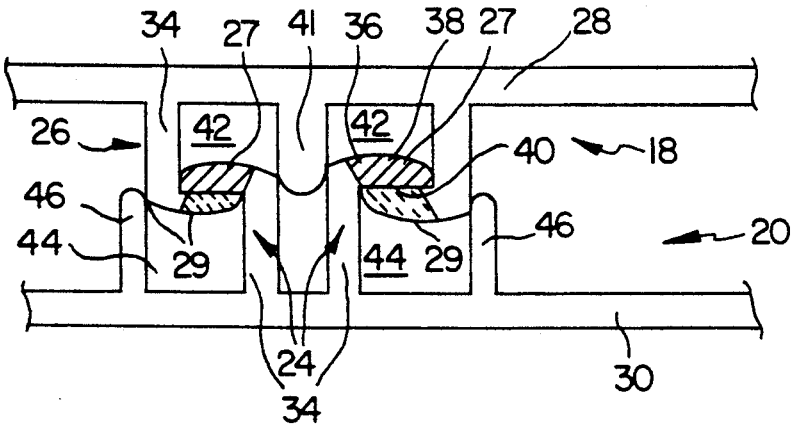
FIG. 2A is a sectional view taken along the line 2A—2A of FIG. 1 depicting structural specifics of a preferred embodiment of this invention.
Figure 2B:
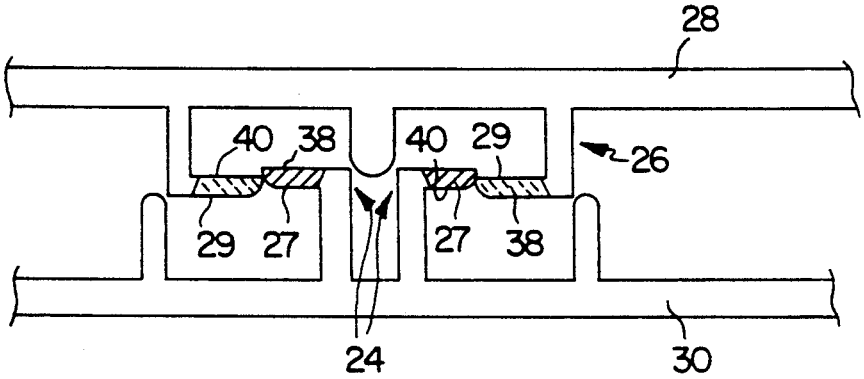
FIG. 2B depicts the preferred embodiment of FIG. 2A wherein the first and second elements are not successfully interlocked to form a seal.

FIG. 2A is an illustration of a first, preferred embodiment of the invention wherein the second closure element 20 includes a pair of hook-like projections 24 projecting from a translucent continuous web 30 in spaced parallel relationship to each other. Each hook-like projection 24 is formed with a stem or stalk 34 extending generally perpendicular to the web 30 and having a hook-like distal end 36 or tip extending approximately perpendicular to its stem 34. The outermost surface 38 of the tip 36 which faces away from the associated web 30 is generally defined by a convex curve and an inner surface 40 of the tip which faces the web 30 is either straight or slightly concave.

The first closure element 18 is also formed with a pair of hook-like projections 26 extending from its associated continuous web 28. These hook-like projections 26 are also formed with a stem 34 and a hooked tip 36 that may be identical in construction to the second members 24 except that the stems 34 of the first hooked projections 26 are spaced further apart from each other than the stems on the second closure elements 24 to define, in cooperation with a wall 41 extending parallel to and between the first members 26, a pair of locking cavities 42. The female hook projections 24 are adapted to enter into the locking cavities 42 by virtue of resiliently yielding bias of the tips 36 of the first and second hook-like projections 24,26 as the continuous webs 28,30 are brought together under manual finger pressure during closure of the bag 10. As depicted in FIG. 2A, full mating engagement of the second and first closure elements 24,26 results in sealing contact between portions of the outermost surface 38 of the tips of the second one 24 with wall 41 of the locking cavity 42 and corresponding sealing contact between the outermost surfaces of the tips of the second members 26 with the corresponding locking cavity 44 formed between the hook-like projections 24 and associated walls 46 formed outwardly and parallel to the hook-like projections.

The interlocking extremities or tips 36 of the second and first elements 24,26 are guided into interlocking engagement within the respective locking cavities 42,44 in response to compressive force placed on the elements 18,20 as in the clamping together of the continuous webs 28,30 under manual finger pressure. In the fully mated position of FIG. 2A, the outermost or upward facing surfaces 38 of the tips 36 on the second elements 24 directly face the translucent web 28 carrying the first elements 26 and are visually observable through the web 28. Likewise, the outermost surfaces 38 on the tips 36 of the first elements 26 are visually observable through the web 30 carrying the second elements 24. Therefore, in accordance with a preferred embodiment of this invention, the tips 36 or extremities of the second elements 24 and thereby the outer surfaces 38 thereof are colored a certain color 27 and the tips 36 or extremities of the first elements 26 and their outer surfaces 38 thereof are colored a second color 29 different from the first color. Thereby, when the second and first elements 24,26 are fully mated together, the first or certain color 27 on the second element tips are visually observable as continuous bands of that color through the translucent web 28 of the first elements 26. Likewise, the second color 29 formed on the first element tips 26 are visually observable as continuous parallel bands through the continuous web 30 of the second elements 24.

In the preferred embodiment, the second element tips 36 are coextruded as the first color 27 with the transparent stems 34 which are formed from a clear resin. The first element tips 36 are coextruded as the second color 29 with transparent stem 34. Optionally, the second and first element tips 36,36 may also be formed of clear resin, instead of colored resin, with the color 27 or 29 being respectively printed on the associated first or second element tip. In either case, the respective color 27 or 29 is visible on both the outer and inner surfaces 38,40 of the associated tip. Thereby, when the closure elements 18,20 have not fully mated together, the inner surfaces 40 of the first and second element tips 36 opposing their associated webs 30,28 are not fully juxtaposed together (and therefore hidden from view through the webs) since the first and second elements tips are not interlocked but are instead somewhat wedged together, side by side, in the manner depicted in FIG. 2B. In accordance with a unique feature of the present invention, this incomplete mated condition is visually observable through one or the other of the continuous webs 28,30 since, for example, the outermost surfaces 38 of the first element tips of said certain color 29 will be disposed side by side or adjacent the innermost surface 40 of the second element tips of the color 27 and, therefore, both the first and second colors 27,29 will be visible as adjacent bands of colors through the continuous web 30. Likewise, the outermost surface 38 of the second element tips 24 will be visually observable as bands of the first color 27 through the web 28 carrying the first element tips 26 and the innermost surfaces 40 of the first element tips will also be observable as bands of the second color 29 through their associated web 28.

The feature of utilizing first and second colors 27,29 in the unique manner set forth above enables easy verification of complete mating by allowing the user to simply search for the presence of only one of two colors 27,29 through only one of the translucent webs 28,30 without searching for color blending as in the prior art. Further, since there is no requirement in the present invention that the colors blend together to form a third color, the first and second colors 27,29 may be chosen without concern as to whether the colors are blendable to form a third color.

Unlike the known prior art wherein the entirety of each male and female closure element is formed of a colored resin, the unique manner in which the present invention functions enables minimal use of a colored resin which is more expansive than a clear resin since, in the preferred embodiment, typically only the interlocking tip extremities 36 of the second and first elements 24,26 are either the first or second color 27,29 with the remainder of the elements (e.g., the stems 34) being co-extruded of a clear and less expensive resin. Of course, if desired, the stems 34 may be colored resin. In addition, as mentioned above, the color 27 or 29 may be printed on the tips 36 instead of being coextruded as a colored resin.

Figure 3:
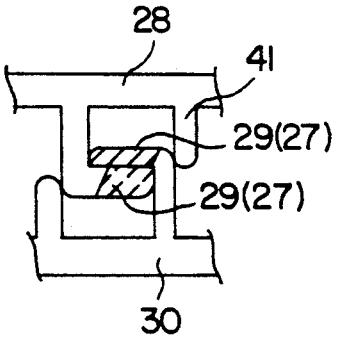
FIG. 3 depicts a second embodiment of the invention.

It is within the scope of this invention to form the tip extremities 36 of both the second and first closure elements of a single color (e.g., 27 or 29) as depicted in FIG. 3. In this embodiment, complete mating of the elements 18,20 is visually ascertainable by the presence of a continuous band of color 27,29 of substantially uniform width observable through one or the other of continuous webs 28,30. In the event of incomplete mating, this condition would be visually observable by a band of color of varying width. In other words, the portions of the first and second elements which have not successfully interlocked would appear as a band portion of color of twice (e.g., FIG. 2B) the thickness relative to portions (e.g., FIG. 2A or 3) of the elements which have successfully interlocked in mating engagement.

Figure 4:
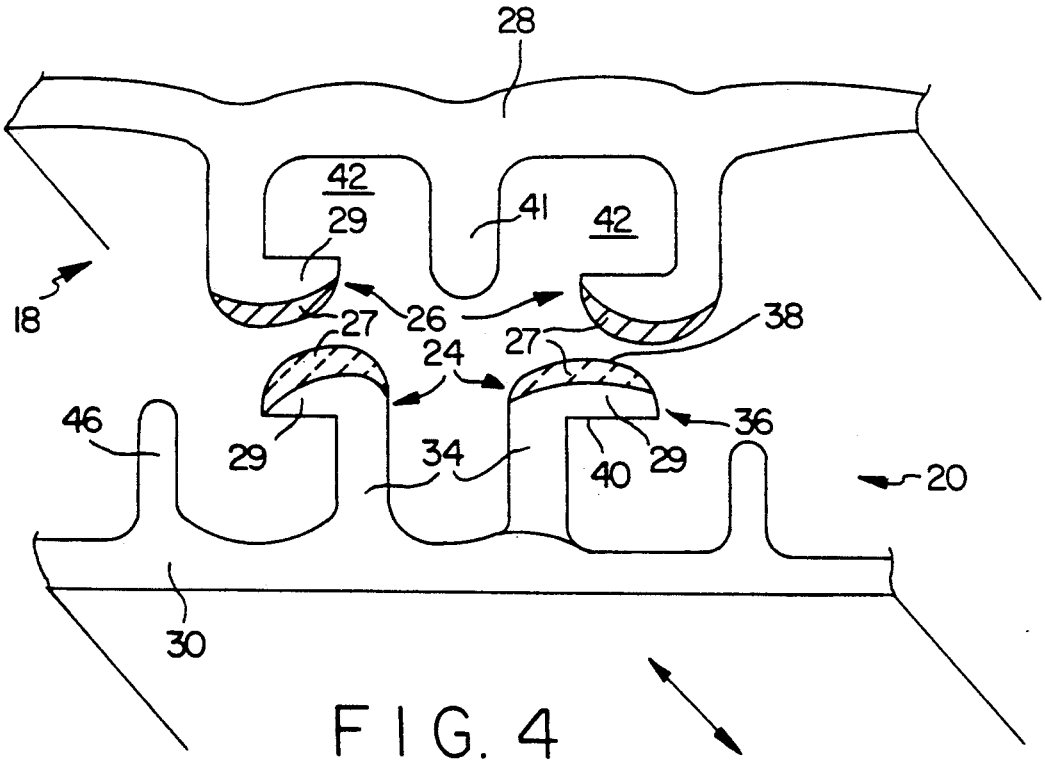
FIG. 4 is a view similar to FIG. 3 depicting a third embodiment of the invention.

In accordance with yet another embodiment of this invention depicted in FIG. 4, the outermost surfaces 38 of the first and second tips 36 may be formed of a first color 27 while the inner surfaces 40 are formed of second color 29. In this embodiment, successful mating engagement of tip extremities will result in the first color 27 being visually observable through either continuous web 28,30 as a pair of continuous bands of said color, respectively. Incomplete mating will result in the first and second colors 27,29 being observable as adjacent band portions through either continuous web 28 or 30, as depicted in a manner similar to FIG. 2B. In the FIG. 4 embodiment, it is to be understood that the second or underlying color 29 may be formed as a backing color (e.g., white) to provide better contrast with the first color 27. The region 40 of the second color 29 may extend only for a small area beneath the tips 36, or may extend for a larger portion of the first and second members, or may even comprise the entire first and second members, except for the tips 36.

In any of the foregoing embodiments, it is to be understood that one or two colors may be formed on each extremity as a co-extrusion with the stems being simultaneously co-extruded from a clear resin. The colors may also be printed.

Figure 5:
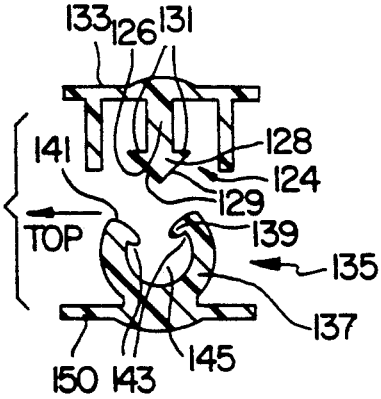
FIG. 5 is a view similar to FIG. 3 depicting a fourth embodiment of the invention.

Another commonly used closure element is depicted in FIG. 5 wherein a first or male element 124 is a single stem 126 (i.e., a rib extending continuously the length of the closure element) having an arrow-shaped distal end 128 of approximately triangular cross-section. In this embodiment, the outer surfaces 129 converging together in a point may be of a first color while the inner surfaces 131 facing the web 133 and connecting the outer surfaces to the stem 126 may be of a second color in a manner similar to the embodiment of FIG. 4. The second or female element 135 is formed with a pair of curved ribs 137 each having hooked distal ends 139 spaced from each other a distance less than the width of the male tip 128. The outermost convex surfaces 141 of the female rib members 137 are colored the first color and the innermost surface 143 of the female rib members extending toward each other to define the entrance to the locking cavity 145 are colored the second color. Upon successful and complete mating engagement of the male and female elements 124,135, the first colors will be visually observable through the translucent webs 133,150 as continuous bands of first color. Incomplete mating will result in adjacent bands of first and second color being simultaneously visually observable through the same translucent web 133 or 150 as discussed supra.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. A container comprising a pair of translucent side walls for defining a container interior and at least one open end; and a closure device including a first closure element and a second closure element, each of said closure elements being formed with a translucent web respectively extending along said side walls adjacent said open end, said first and second closure elements being mateable so that, upon mating engagement of said first and second closure elements along their substantially entire respective lengths, said open end is substantially entirely closed, wherein a tip portion of said first closure element adapted to directly face and being visually observable through said at least one web carrying the second closure element is a certain color and a tip portion of said second closure element adapted to directly face and being visually observable through the other web carrying the first closure element is colored a second color different from said certain color, so that upon complete mating said certain color and said second color are observable through the respective opposing webs as a continuous band of said color, and upon incomplete mating, both said certain color and said second color are visually observable through the opposing web as adjacent bands of said colors along the region of incomplete mating and as an indication thereof, wherein at least one of the first and second closure elements include a stem projecting upward from its associated web, said stem supporting a distal end or tip of said at least one first or second closure element, said distal end or tip being said tip portion, wherein said second closure element comprises a pair of interlockable members which are spaced from each other along one web and said first closure element comprises a pair of interlockable members of similar construction as said second closure element which are spaced from each other on the opposite web a distance apart slightly greater than the spacing between the interlockable members of said second closure element and which web carrying the first closure element also supports a wall extending between the interlockable members of the first closure element to define locking cavities therewith adapted to respectively receive said interlockable members of said second closure element therein whose tips interlock by interfitting with and beneath the corresponding tips of the first closure element.

2. The container of claim 1 further including a backing layer on said first closure element of a color which is different from said certain color and visually impenetrable and which underlies and is coextensive with said certain color to improve contrast.

3. The container of claim 1 further including a backing layer on said first and second closure elements which underlies each of said certain color and said second color to improve contrast.

4. A container comprising a pair of translucent side walls for defining a container interior and at least one open end; and a closure device including a first closure element and a second closure element, each of said closure elements being formed with a translucent web respectively extending along said side walls adjacent said open end, said first and second closure elements being mateable so that, upon mating engagement of said first and second closure elements along their substantially entire respective lengths, said open end is substantially entirely closed, and wherein a tip portion of at least one of said first and second closure elements is colored a certain color so that upon substantially entirely complete mating of said first and second closure elements, said certain color is visually observable through an opposing one of said webs as a continuous band of said certain color, wherein said second closure element comprises a pair of interlockable members which are spaced from each other along one web and said first closure element comprises a pair of interlockable members of similar construction as the second closure element which are spaced from each other on the opposite web a distance apart slightly greater than the spacing between the interlockable members of the second closure element and which web carrying the first closure element also supports a wall extending between the interlockable members of the first closure element to define locking cavities therewith adapted to respectively receive said interlockable members of said second closure element therein whose tips interlock by interfitting with and beneath the corresponding tips of the first closure element, and wherein said tips of the first and second closure elements are each said certain color.

5. A container comprising a pair of translucent side walls for defining a container interior and at least one open end; and a closure device including a first closure element and a second closure element, each of said closure elements being formed with a translucent web respectively extending along said side walls adjacent said open end, said first and second closure elements being mateable so that, upon mating engagement of said first and second closure elements along their substantially entire respective lengths, said open end is substantially entirely closed, and wherein a tip portion of at least one of said first and second closure elements is colored a certain color so that upon substantially entirely complete mating of said first and second closure elements, said certain color is visually observable through an opposing one of said webs as a continuous band of said certain color, and wherein those portions of said at least one first or second closure element other than said tip portion are made of a clear resin and said certain color is produced by a colored resin.

6. A method of determining whether a translucent flexible bag container is closed, said container having at least one open end carrying a closure device which includes a first closure element and a second closure element which are mateable with each other so that upon mating engagement along their substantially entire lengths, said open end is substantially entirely closed, at least one of said first and second closure elements being at least partly colored at a tip portion thereof at least one certain color, comprising the steps of:

a) interlocking the first closure element with the second closure element; and b) visually observing the mated closure elements through a translucent web supporting an associated one of said first or second closure elements to determine whether said certain color appears through said web as a continuous band of said certain color which signifies that full mating has occurred, wherein said first closure element is said certain color and the second closure element is a second color different from said certain color, and wherein each is separately visually observable, through an opposing web, as a continuous band of said certain color or said second color to signify full mating, and wherein both said certain color and said second color are visually observable through at least one of said webs when full mating has not occurred.

7. A closure device for a translucent container comprising a first closure element and a second closure element, each of said closure elements being formed with a translucent web adapted to extend along an open end of said container and being mateable with each other so that, upon mating engagement of said first and second closure elements along their substantially entire respective lengths, said open end is substantially entirely closed, and wherein a tip portion of at least one of said first and second closure elements is colored a certain color so that upon substantially entirely mating of said closure elements, said certain color is visually observable through at least the opposing web as a continuous band of said certain color, wherein a tip portion of said first closure element adapted to directly face and being visually observable through the opposing web carrying the second closure element is said certain color and a tip portion of said second closure element adapted to directly face and being visually observable through the other opposing web carrying the first closure element is colored a second color different from said certain color, so that upon complete mating said certain color and said second color are observable through the respective opposing web as a continuous band of said color, and upon incomplete mating, both said certain color and said second color are visually observable through the opposing web as adjacent bands of said colors along the region of incomplete mating and as an indication thereof.

8. The closure device of claim 7 wherein at least one of the first and second closure elements includes a stem projecting upward from its associated web, said stem supporting a distal end or tip of said at least one first or second closure element, said distal end or tip being said tip portion.

9. A container comprising a pair of translucent side walls for defining a container interior and at least one open end; and a closure device including a first closure element and a second closure element, each of said closure elements being formed with a translucent web respectively extending along said side walls adjacent said open end, said first and second closure elements being mateable so that, upon mating engagement of said first and second closure elements along their substantially entire respective lengths, said open end is substantially entirely closed, and wherein a tip portion of at least one of said first and second closure elements is colored a certain color so that upon substantially entirely complete mating of said first and second closure elements, said certain color is visually observable through an opposing one of said webs as a continuous band of said certain color, and wherein said second closure element comprises a pair of interlockable members which are spaced from each other along one web and said first closure element comprises a pair of interlockable members of similar construction of said second closure element which are spaced from each other on the opposite web a distance apart slightly greater than the spacing between said interlockable members of said second closure element and which web carrying the first closure element also supports a wall extending between the interlockable members of the first closure element to define locking cavities therewith adapted to respectively receive said interlockable members of said second closure element therein whose tips interlock by interfitting with and beneath the corresponding tips of the first closure element, wherein the tips of said second closure element are colored said certain color and are visually observable through the opposing web carrying the first closure element when complete mating occurs.

10. A container comprising a pair of translucent side walls for defining a container interior and at least one open end; and a closure device including a first closure element and a second closure element, each of said first and second closure elements being formed with a translucent web respectively extending along said side walls adjacent said open end, said first and second closure elements being mateable so that, upon mating engagement of said first and second closure elements along their substantially entire respective lengths, said open end is substantially entirely closed, and wherein a tip portion of at least one of said first and second closure elements is colored a certain color so that upon substantially entirely complete mating of said first and second closure elements, said certain color is visually observable through an opposing one of said webs as a continuous band of said certain color, wherein the remainder of said first or second closure element other than said tip portion is made of a translucent or clear resin coextruded with said tip portion of the first or second closure element which is made of a colored resin different from said transparent or clear resin.

* * * * *